US008398831B2

(12) United States Patent
Ghongadi et al.

(10) Patent No.: US 8,398,831 B2
(45) **Date of Patent: *Mar. 19, 2013**

(54) RAPIDLY CLEANABLE ELECTROPLATING CUP SEAL

(75) Inventors: Shantinath Ghongadi, Wilsonville, OR (US); Robert Rash, Portland, OR (US); Jeff Hawkins, Portland, OR (US); Seshasayee Varadarajan, Lake Owsego, OR (US); Tariq Majid, Wilsonville, OR (US); Kousik Ganesan, Hillsboro, OR (US); Bryan Buckalew, Tualatin, OR (US); Brian Evans, Elmira, OR (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/079,745

(22) Filed: Apr. 4, 2011

(65) Prior Publication Data

US 2011/0181000 A1 Jul. 28, 2011

Related U.S. Application Data

(63) Continuation of application No. 11/932,595, filed on Oct. 31, 2007, now Pat. No. 7,935,231.

(51) Int. Cl.
*C25D 17/00* (2006.01)
*C25D 9/00* (2006.01)
*F16J 15/00* (2006.01)

(52) U.S. Cl. ..... 204/297.14; 204/297.01; 204/297.05; 204/297.06; 204/297.07; 204/297.08; 204/297.09; 204/297.1; 204/279; 277/650

(58) Field of Classification Search ..... 204/297.01, 204/297.05, 297.06, 197.07, 297.08, 297.09, 204/297.1, 297.14, 279; 277/650
See application file for complete search history.

(56) References Cited

U.S. PATENT DOCUMENTS

| | | | |
|---|---|---|---|
| 4,466,864 | A | 8/1984 | Bacon et al. |
| 5,000,827 | A | 3/1991 | Schuster et al. |
| 5,221,449 | A | 6/1993 | Colgan et al. |
| 5,227,041 | A | 7/1993 | Brogden et al. |
| 5,281,485 | A | 1/1994 | Colgan et al. |
| 5,482,611 | A | 1/1996 | Helmer et al. |
| 5,853,559 | A | 12/1998 | Tamaki et al. |
| 5,985,762 | A | 11/1999 | Geffken et al. |
| 6,074,544 | A | 6/2000 | Reid et al. |
| 6,099,702 | A | 8/2000 | Reid et al. |

(Continued)

FOREIGN PATENT DOCUMENTS

| | | |
|---|---|---|
| WO | WO 99/41434 | 8/1999 |
| WO | WO 03/006718 | 1/2003 |

OTHER PUBLICATIONS

Office Action for U.S. Appl. No. 11/929,632, dated Jun. 25, 2008, in 9 pages.

(Continued)

*Primary Examiner* — Bruce Bell
(74) *Attorney, Agent, or Firm* — Knobbe Martins Olson & Bear LLP

(57) ABSTRACT

Embodiments of a closed-contact electroplating cup assembly that may be rapidly cleaned while an electroplating system is on-line are disclosed. One disclosed embodiment comprises a cup assembly and a cone assembly, wherein the cup assembly comprises a cup bottom comprising an opening, a seal surrounding the opening, an electrical contact structure comprising a plurality of electrical contacts disposed around the opening, and an interior cup side that is tapered inwardly in along an axial direction of the cup from a cup top toward the cup bottom.

27 Claims, 5 Drawing Sheets

U.S. PATENT DOCUMENTS

| | | | | |
|---|---|---|---|---|
| 6,110,346 | A | 8/2000 | Reid et al. | |
| 6,124,203 | A | 9/2000 | Joo et al. | |
| 6,126,798 | A | 10/2000 | Reid et al. | |
| 6,139,712 | A | 10/2000 | Patton et al. | |
| 6,156,167 | A | 12/2000 | Patton et al. | |
| 6,159,354 | A | 12/2000 | Contolini et al. | |
| 6,162,344 | A | 12/2000 | Reid et al. | |
| 6,176,985 | B1 | 1/2001 | Downes, Jr. et al. | |
| 6,179,973 | B1 | 1/2001 | Lai et al. | |
| 6,179,983 | B1 | 1/2001 | Reid et al. | |
| 6,193,854 | B1 | 2/2001 | Lai et al. | |
| 6,217,716 | B1 | 4/2001 | Lai | |
| 6,221,757 | B1 | 4/2001 | Schmidbauer et al. | |
| 6,251,238 | B1 | 6/2001 | Kaufman et al. | |
| 6,251,242 | B1 | 6/2001 | Fu et al. | |
| 6,261,433 | B1 | 7/2001 | Landau | |
| 6,267,860 | B1 | 7/2001 | Brodsky | |
| 6,270,646 | B1 | 8/2001 | Walton et al. | |
| 6,274,008 | B1 | 8/2001 | Gopalraja et al. | |
| 6,277,249 | B1 | 8/2001 | Gopalraja et al. | |
| 6,303,010 | B1 | 10/2001 | Woodruff et al. | |
| 6,413,388 | B1 | 7/2002 | Uzoh | |
| 6,436,249 | B1 | 8/2002 | Patton et al. | |
| 6,517,689 | B1 | 2/2003 | Hongo et al. | |
| 6,540,899 | B2 | 4/2003 | Keigler | |
| 6,551,487 | B1 | 4/2003 | Reid et al. | |
| 6,579,430 | B2 | 6/2003 | Davis et al. | |
| 6,589,401 | B1 * | 7/2003 | Patton et al. | 204/212 |
| 6,612,915 | B1 | 9/2003 | Uzoh et al. | |
| 6,613,214 | B2 | 9/2003 | Dordi et al. | |
| 6,627,052 | B2 | 9/2003 | Fluegel et al. | |
| 6,755,946 | B1 | 6/2004 | Patton et al. | |
| 6,755,954 | B2 | 6/2004 | Mayer et al. | |
| 6,773,560 | B2 | 8/2004 | Pedersen et al. | |
| 6,800,187 | B1 | 10/2004 | Reid et al. | |
| 6,869,510 | B2 | 3/2005 | Woodruff et al. | |
| 6,908,540 | B2 * | 6/2005 | Kholodenko | 205/118 |
| 7,033,465 | B1 | 4/2006 | Patton et al. | |
| 7,070,686 | B2 | 7/2006 | Contolini et al. | |
| 7,087,144 | B2 | 8/2006 | Herchen | |
| 7,522,055 | B2 | 4/2009 | Carrender et al. | |
| 7,935,231 | B2 * | 5/2011 | Ghongadi et al. | 204/297.1 |
| 7,985,325 | B2 * | 7/2011 | Rash et al. | 204/242 |
| 2002/0084183 | A1 | 7/2002 | Hanson et al. | |
| 2002/0108851 | A1 | 8/2002 | Woodruff et al. | |
| 2002/0144900 | A1 | 10/2002 | Keigler | |
| 2003/0010641 | A1 | 1/2003 | Kholodenko | |
| 2003/0085118 | A1 | 5/2003 | Tench et al. | |
| 2003/0085119 | A1 * | 5/2003 | Davis et al. | 204/286.1 |
| 2004/0084301 | A1 | 5/2004 | Dordi et al. | |
| 2006/0246690 | A1 | 11/2006 | Dordi et al. | |
| 2008/0117051 | A1 | 5/2008 | Carrender et al. | |
| 2009/0107835 | A1 | 4/2009 | Ghongadi et al. | |
| 2009/0107836 | A1 | 4/2009 | Rash et al. | |
| 2010/0155254 | A1 | 6/2010 | Prabhakar et al. | |
| 2011/0233056 | A1 * | 9/2011 | Rash et al. | 204/297.01 |

OTHER PUBLICATIONS

Notice of Allowance for U.S. Appl. No. 11/929,632, dated Dec. 15, 2008, in 5 pages.
Office Action for U.S. Appl. No. 12/633,219, dated Nov. 1, 2011, in 20 pages.
Office Action for U.S. Appl. No. 13/154,224, dated Nov. 4, 2011, in 15 pages.
Search Report and Written Opinion from Hungarian Intellectual Property Office for Singapore Patent Application No. 200908245.4, dated Mar. 9, 2011.
Notice of Allowance for U.S. Appl. No. 11/932,595, dated Mar. 8, 2011, in 8 pages.
Supplemental Notice of Allowance for U.S. Appl. No. 11/932,595, dated Mar. 11, 2011, in 2 pages.
Notice of Allowance for U.S. Appl. No. 11/929,638, dated May 23, 2011, in 8 pages.
Shin-Etsu Polymer Co., Ltd., "L-Type Connector," http://www.shinpoly.co.jp/business/connector/products_e/l.html?typezeb (1 page) downloaded Feb. 16, 2011.
Shin-Etsu Polymer Co., Ltd., "SS-Type Connector," http://www.shinpoly.co.jp/business/connector/products_e/ss.html?typezeb (2 pages) downloaded Feb. 16, 2011.
Office Action for U.S. Appl. No. 09/927,741, dated May 15, 2003, in 14 pages.
Final Office Action for U.S. Appl. No. 09/927,741, dated Oct. 7, 2003, in 10 pages.
Office Action for U.S. Appl. No. 09/927,741, dated Feb. 26, 2004, in 11 pages.
Notice of Allowance for U.S. Appl. No. 09/927,741, dated Jun. 1, 2004, in 12 pages.
Office Action for U.S. Appl. No. 10/010,954, dated Oct. 8, 2003, in 19 pages.
Notice of Allowance for U.S. Appl. No. 10/010,954, dated Feb. 26, 2004, in 7 pages.
Notice of Allowance for U.S. Appl. No. 10/309,414, dated Oct. 27, 2005, in 14 pages.
Office Action for U.S. Appl. No. 11/929,638, dated Mar. 2, 2011, in 16 pages.
Office Action for U.S. Appl. No. 11/932,595, dated Jul. 7, 2010, in 28 pages.
Final Office Action for U.S. Appl. No. 11/932,595, dated Nov. 17, 2010, in 11 pages.
Notice of Allowance for U.S. Appl. No. 11/932,595, dated Jan. 26, 2011, in 7 pages.
Notice of Allowance for U.S. Appl. No. 11/932,595, dated Mar. 18, 2011, in 6 pages.
Final Office Action in U.S. Appl. No. 13/154,224, dated Jul. 18, 2012.
Office Action for U.S. Appl. No. 13/154,224, dated Mar. 16, 2012, in 13 pages.
Notice of Allowance issued in U.S. Appl. No. 13/154,224, dated Oct. 4, 2012.

* cited by examiner

RAPIDLY CLEANABLE ELECTROPLATING CUP SEAL

CROSS-REFERENCE TO RELATED APPLICATIONS

This application is a continuation of U.S. patent application Ser. No. 11/932,595, filed Oct. 31, 2007 and issued as U.S. Pat. No. 7,935,231 on May 3, 2011, which is incorporated herein by reference in its entirety.

BACKGROUND

Electroplating is commonly used in integrated circuit manufacturing processes to form electrically conductive structures. For example, in a copper damascene process, electroplating is used to form copper lines and vias within channels previously etched into a dielectric layer. In such a process, a seed layer of copper is first deposited into the channels and on the substrate surface via physical vapor deposition. Then, electroplating is used to deposit a thicker copper layer over the seed layer such that the channels are completely filled. Excess copper is then removed by chemical mechanical polishing, thereby forming the individual copper features.

Current electroplating systems may be classified as "open contact" and "closed contact." Open contact plating systems are systems in which the wafer contacts that deliver electric current to the seed layer during plating are exposed to the plating solution. Likewise, closed contact plating systems are those in which the contacts are not exposed to the plating solution.

Both open and closed contact electroplating systems may undergo a cleaning process on a scheduled basis to ensure proper system performance. For example, in a closed contact system, scheduled maintenance may be periodically performed to remove plating solution residues that may be potentially deposited in the cup by removal of wafers from the cup. However, such maintenance may involve relatively slow and labor-intensive manual processes. This may involve taking the electroplating system offline during cleaning, thereby causing system downtime and decreased throughput.

SUMMARY

Accordingly, embodiments of a closed-contact electroplating cup that may be rapidly cleaned while an electroplating system is on-line are disclosed. For example, in one disclosed embodiment, a closed-contact electroplating system comprises a cup assembly and a cone assembly, wherein the cup assembly comprises a cup bottom comprising an opening, a seal surrounding the opening, an electrical contact structure comprising a plurality of electrical contacts disposed around the opening, and an interior cup side that is tapered inwardly in along an axial direction of the cup from a cup top toward the cup bottom.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
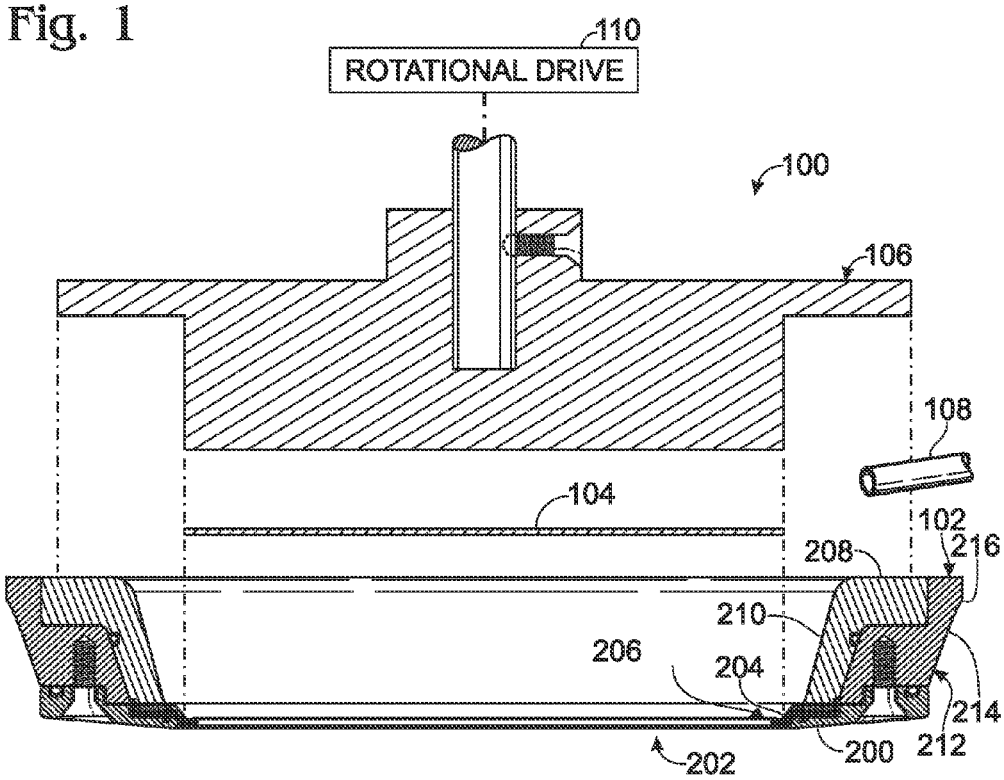
FIG. 1 shows embodiments of an electroplating substrate holder comprising a cone assembly and a cup assembly.

FIG. 1 shows an embodiment of a closed contact substrate holder 100 for holding a wafer during an electroplating process. The substrate holder 100 may also be referred to herein as "clamshell 100." The clamshell 100 comprises a cup assembly 102 in which a wafer 104 is positioned during an electroplating process, and also a cone assembly 106 that is lowered into the cup to clamp the wafer within the cup assembly 102 during a plating process. The clamshell 100 may be utilized in an electroplating system that also comprises a nozzle 108 configured to provide a flow of a fluid such as deionized water for a cleaning process, and a rotational drive 110 configured to rotate the clamshell during an electroplating process and/or a cleaning process.

The depicted clamshell is a closed contact system in which the electrical contacts in the cup form an electrical connection with a wafer in the cup and are not exposed to the plating solution during a plating process, and generally remain clean from plating solution. However, upon removing the cup assembly 102 and cone 106 from the plating solution after completing a plating process, small amounts of plating solution may remain on the wafer surface and/or on the seal that seals the contacts from the plating solution. Removal of the wafer from the cup assembly 102 may occasionally cause some amount of this residual plating solution to contaminate the electrode region and other interior regions of the cup assembly 102.

The substrate holder 100 comprises various features that allow the cup assembly 102 to be quickly and easily cleaned via an automatic spin-rinse process performed while the electroplating system is on-line and between process batches. In contrast, other electroplating systems may require frequent manual cleanings during which the cup is removed from the electroplating system by a technician and cleaned by hand. Such a manual cleaning process, which generally involves taking the electroplating system off-line, may result in a greater amount of downtime for such systems, and therefore may lower system throughput.

Figure 2:
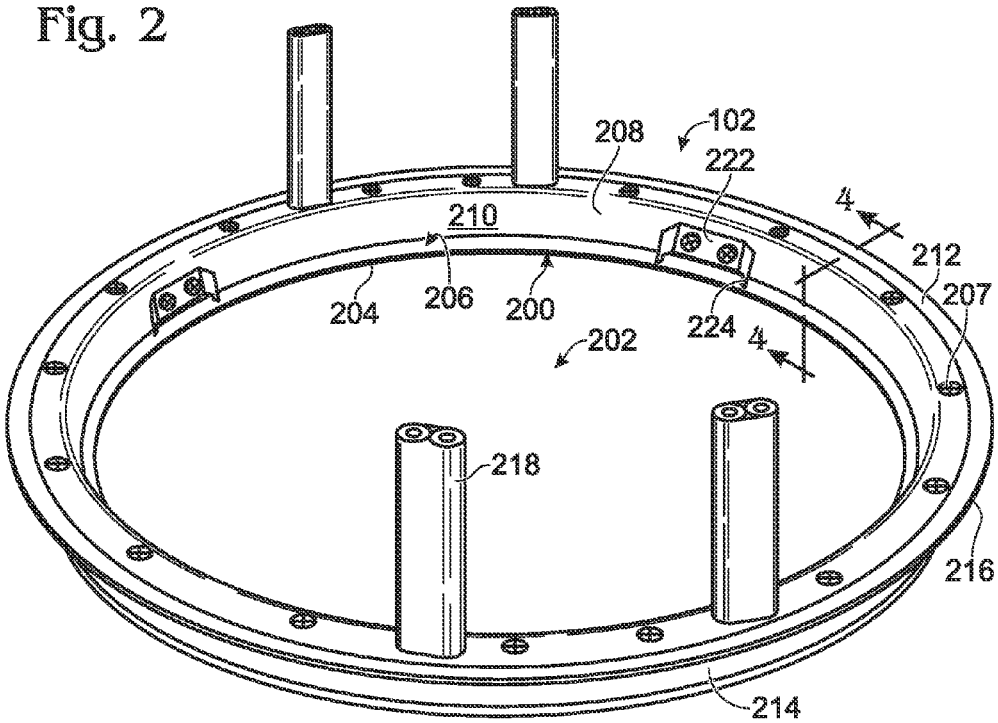
FIG. 2 shows a perspective view of the embodiment of the electroplating cup assembly of FIG. 1.
Figure 3:
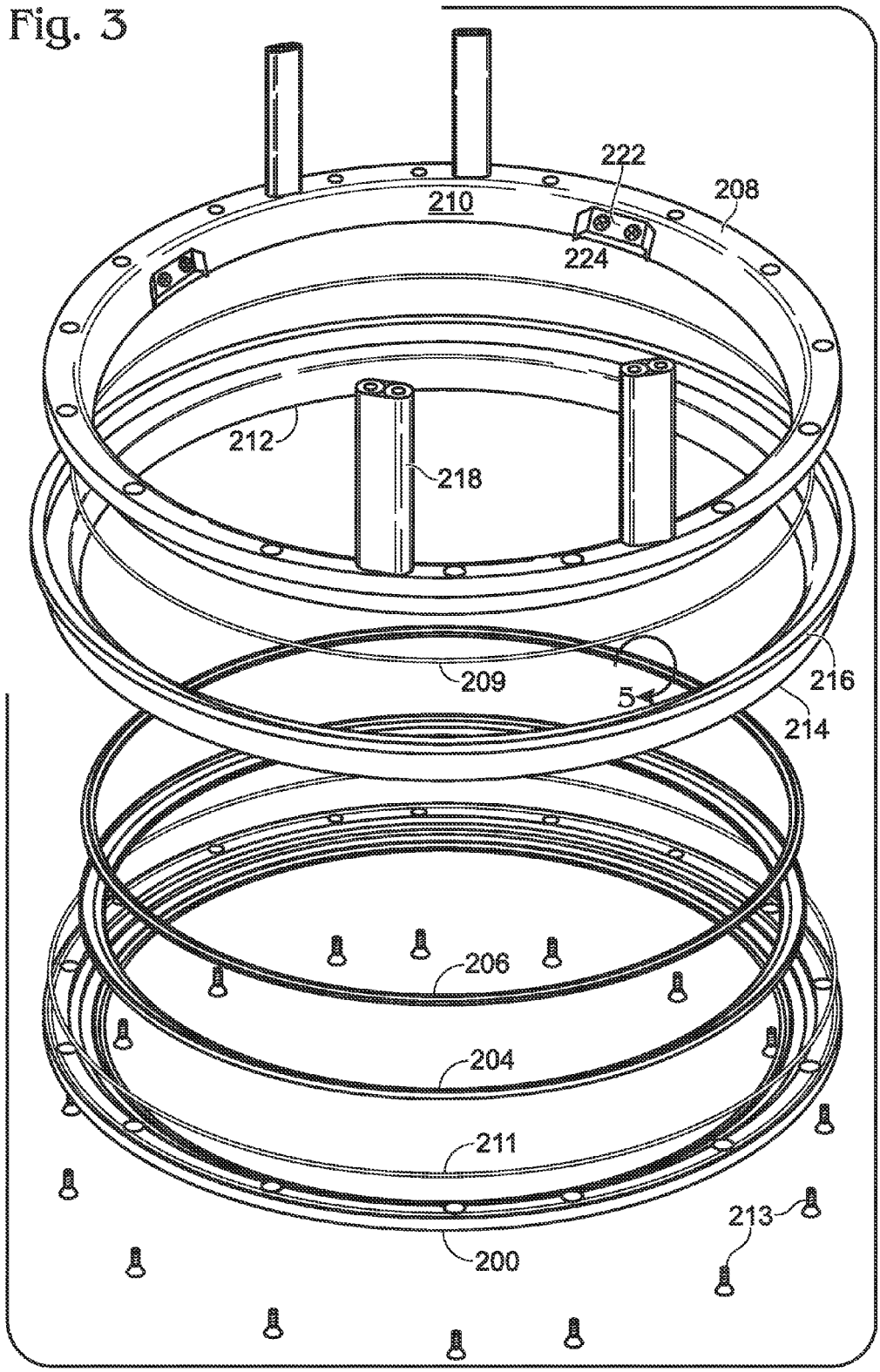
FIG. 3 shows an exploded view of the embodiment of FIG. 2.

Referring now to FIGS. 1-3, the cup assembly 102 comprises several major components. First, the cup assembly 102 comprises a cup bottom 200 that defines an opening 202 to allow exposure of a wafer positioned in the cup assembly 102 to an electroplating solution. A seal 204 is positioned on the cup bottom 200 around the opening 202, and is configured to form a seal against a wafer to prevent plating solution from reaching the contacts located behind the seal.

The cup bottom 200 may be made from any suitable material. Suitable materials include materials capable of demonstrating high strength and stiffness at the thicknesses used for the cup bottom, and also that resist corrosion by low pH plating solutions, such as copper/sulfuric acid solutions. One specific non-limiting example of a suitable material is titanium.

The seal 204 also may be formed from any suitable material. Suitable materials include materials that do not react with or are not corroded by the acidic solutions used for plating, and of a sufficiently high purity not to introduce contaminants into the plating solution. Examples of suitable materials include, but are not limited to, perfluoro polymers sold under the name Chemraz, available from Greene, Tweed of Kulpsville, Pa. In some embodiments, the seal 204 may be coated with a hydrophobic coating. This may allow the seal 204 to shed aqueous plating solution when removed from a plating bath, and also may facilitate the removal of water from the seal 204 during a spin-rinse process. Other details of the seal that facilitate the spin-rinsing of the cup assembly 102 are described below with reference to FIG. 4.

Continuing with FIGS. 1-3, the cup assembly 102 further comprises an electrical contact structure 206 configured to form an electrically conductive connection between an external power supply and a wafer positioned in the cup assembly 102. The position of the contact structure is indicated in FIGS. 1-2, and a general view of the part is shown in FIG. 3. As shown in these figures, the seal 204 is positioned between the contact structure 206 and the cup bottom 200, and thereby insulates the cup bottom 200 from the electrical contact structure 206. Details of the contact structure are also described below with reference to FIGS. 4-5.

Continuing with FIGS. 1-3, the electrical contact structure 206 is electrically connected to a conductive ring 208 that rests on an outer portion of the electrical contact structure 206. The conductive ring 208 may also be referred to herein as a "bus bar 208". The depicted bus bar 208 is configured as a continuous, thick ring of metal having an interior side 210 that tapers inwardly, i.e. toward a center of the ring, in an axial direction from the top of the ring toward the bottom of the ring (with reference to the orientation shown in FIGS. 2-3). This shape permits cleaning fluids on the inner surface of the ring to be shed by rotating the cup at a sufficiently high rate of speed. This is in contrast to cups having vertical sides, wherein cleaning fluids cannot easily be removed by a spin process. While the depicted bus bar has a continuous construction, it will be appreciated that a bus bar may also have a segmented or other non-continuous construction without departing from the scope of the present invention.

The tapered interior side of the bus bar 208 may have any suitable angle relative to the wafer surface plane. The angle selected for use may depend upon various factors, including but not limited to the rate at which the cup assembly 102 is spun during a rinse process, geometrical considerations such as space constraints and wafer size, etc. In the specific example of a cup assembly 102 that is spun at 400 rpm during rinsing, suitable angles include, but are not limited to angles, in the range of 81 degrees or less. In one specific embodiment, an angle of approximately 75 degrees is used. Further, while the interior surface of the cup assembly 102 is depicted as being defined by the bus bar 208, it will be appreciated that the tapered interior side of the cup may be formed from any other suitable component. For example, in some embodiments, an electrically insulating shield (not shown) positioned over the interior side of the bus bar 208 may form the interior side of the cup assembly 102.

The bus bar 208 is positioned within and substantially surrounded by a shield structure 212 that electrically insulates the bus bar 208 from the cup bottom 200 and from the plating solution. An o-ring 209 may be located between the bus bar 208 and shield structure 212 to seal the space between these structures, and one or more bolts 207 or other fasteners may be used to secure these structures together. Likewise, an o-ring 211 may be located between the shield structure 212 and the cup bottom 200 to prevent plating solution from reaching the spaces between these structures. One or more bolts 213 may also be used to hold these structures together.

The shield structure 212 may have a tapered outer surface 214, and an outwardly curved upper lip 216. These structures may deflect any plating solution splashed by entry of the substrate holder 100 into a plating bath away from the cup assembly 102 and cone 106, and thereby help to prevent contamination of these parts In other embodiments, the outer surface of the shield structure 212 may have other suitable configurations, and/or may omit the outwardly curved lip 216.

An electrical connection is made to the bus bar 208 through a plurality of struts 218 that extend from a top surface of the bus bar 208. The struts 218 are made from an electrically conductive material, and act as a conductor through which electrical current reaches the bus bar 208. In some embodiments, the struts 218 may be coated with an insulating coating. The struts 218 also structurally connect the cup assembly 102 to a vertical drive mechanism (not shown) that allows the cup to be lifted from and lowered into a plating solution, and also connect the cup to the rotational drive mechanism 110. The location of struts 218 internal to the bus bar 208, rather than on an outside portion of the cup, helps to prevent the formation of a wake caused by the struts 218 pulling through the plating solution during rotation of the clamshell 100 in a plating process. This may help to avoid introduction of plating solution into the space between the cup and cone during a plating process, and therefore may help to reduce a frequency at which preventative maintenance is performed. While the depicted embodiment comprises four struts, it will be appreciated that any suitable number of struts, either more than or fewer than four, may be used.

The depicted struts 218 have an elongate cross-sectional configuration that is oriented at a diagonal to the radial dimension of the cup assembly 102. This may reduce the interference of the struts with a stream of water directed at the cup assembly 102 during a spin-rinse process. Alternatively, any other suitable strut configuration may be used.

Continuing with FIGS. 2-3, a wafer centering mechanism is provided to hold a wafer in a correct location within the cup assembly 102. The depicted wafer centering mechanism comprises a plurality of leaf springs 222 positioned around an inside of the bus bar 208. Each leaf spring 222 comprises a pair of downwardly-extending ends 224 that contact an edge of a wafer positioned in the cup. The spring forces exerted by each leaf spring 222 balance to hold the wafer in a correct position relative to the seal 204, contact structure 206, etc.

Figure 4:
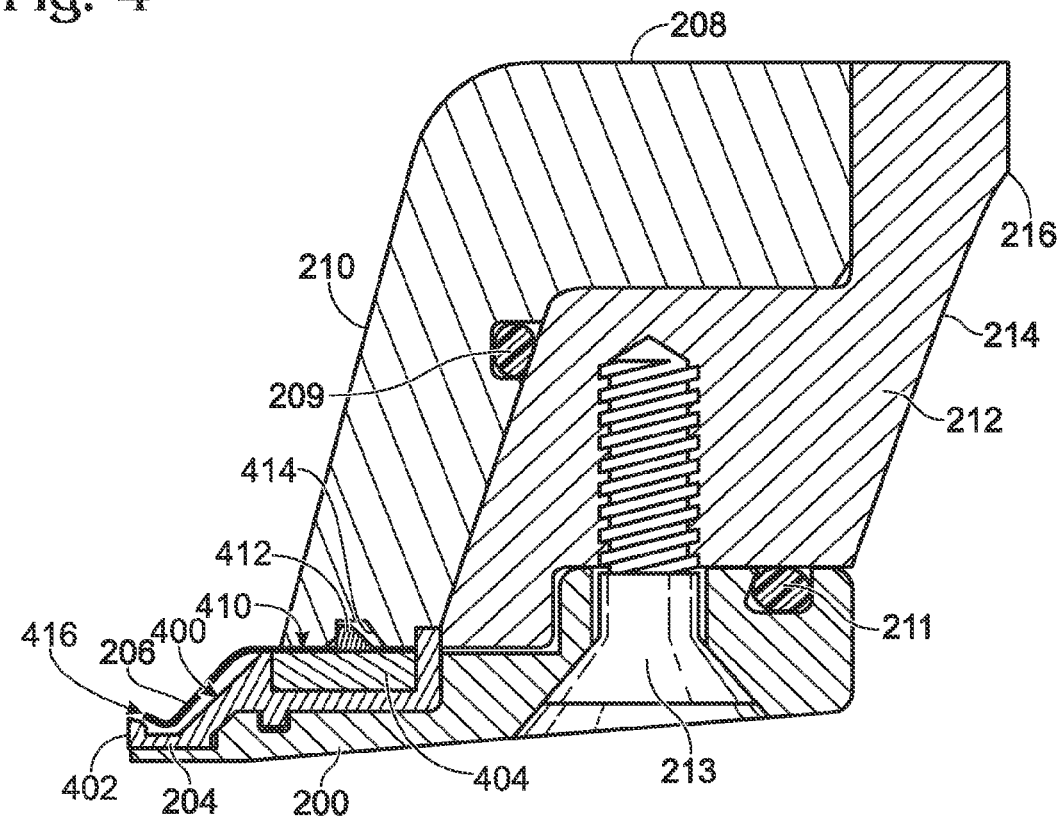
FIG. 4 shows a sectional view of the embodiment of FIG. 2.

Next, FIG. 4 shows a sectional view of cup assembly 102, and illustrates other features of the cup assembly 102 that enable the spin-rinse cleaning of the cup assembly 102. First, the seal 204 comprises an elongate fluid-shedding structure 400 that tapers upwardly and outwardly away from an inner edge 402 of the seal. The depicted fluid shedding structure 400 comprises a bottom surface contoured to fit the tapered upper side of the cup bottom 200. However, it will therefore be appreciated that the fluid shedding structure 402 may have any suitable configuration to fit any specific cup bottom geometry.

The fluid shedding structure 400 extends from a location adjacent to the inner edge 402 of the seal to a location adjacent to the bottom edge of the bus bar 208. Thus, when the cup assembly 102 is rotated at a sufficient speed, any fluid located on the fluid shedding structure 400 is forced upwardly toward the interior side of the bus bar 208, and then upwardly along the bus bar 208 and out of the cup, by the force exerted by the rotating cup assembly 102. The depicted fluid shedding structure 400 has a somewhat shallower angle with respect to the surface of a wafer positioned in the cup than the interior side of the bus bar 208. However, it will be understood that the fluid shedding structure 400 may have any suitable angle relative to the interior side of the bus bar 208 without departing from the scope of the present invention. The selection of angle for the fluid shedding structure 400 may depend upon various factors, including but not limited to the manufacturability of the seal, spring characteristics of the contact structure 206, and the rate(s) of rotation used in the spin-rinsing process, and the strength of the cup bottom. For a cup assembly that is spun at a rate of 400 rpm or greater, suitable angles include angles in the range of 45+/−10 degrees. Angles outside of this range may also be used, but low angles may cause higher levels of cup bottom stress, while higher angles may affect the performance of the contacts. Additionally, as mentioned above, the seal may comprise a hydrophobic coating so that the seal sheds aqueous plating solutions and cleaning water more easily.

The seal 204 may further comprise a keying feature configured to hold the seal 204 in a desired location on the cup bottom. This may help locate the seal 204 in a correct location during installation and replacement of the seal, and also may help to resist displacement of the seal during normal use and cleaning. The depicted keying feature comprises a protrusion configured to fit within a complimentary groove of the cup bottom 200; however, other suitable keying features may be used.

The seal 204 further comprises feature, such as a groove formed in its upper surface, that is configured to accommodate a stiffening ring 404. The stiffening ring is seated within the groove to provide support to the seal and help achieve tighter manufacturing tolerances. In some embodiments, the seal 204 may be bonded to the stiffening ring for additional robustness.

Figure 5:
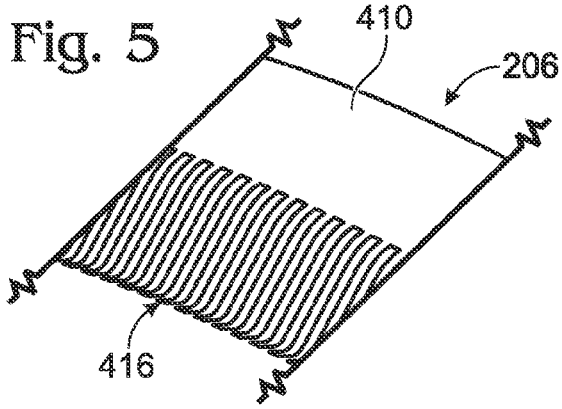
FIG. 5 shows a magnified view of an embodiment of an electrical contact assembly for an electroplating cup assembly.

Referring next to FIGS. 4 and 5, the contact structure 206 also has a design configured to facilitate the spin-rinse of the cup assembly 102. The contact structure 206 comprises a continuous outer ring 410 that is positioned beneath and in contact with the bus bar 208 to allow uniform distribution of current from the bus bar 208 to the contact structure 206. Further, the contact structure comprises a plurality tabs 412 that extend upwardly from a central portion of the outer ring 410 of the contact structure and into a groove 414 formed in the bus bar 408. As shown in FIG. 3, the tabs 412 contact an inner edge of the groove 414. The tabs are configured to center the contact structure 206 in a correct location relative to the seal 204 and cup bottom 200 to ensure that all of the individual contacts (described below) on the contact structure 206 touch the plating seed layer on a wafer positioned in the cup. Further, this feature also helps prevent any contacts from slipping past the seal 204 during a spin-rinse process. The bus bar 208 may comprise a single groove 414 that extends partially or fully around the bus bar 208, or may comprise two or more individual grooves that each accommodates one or more tabs 412.

The contact structure 206 also comprises a plurality of contacts 416 that extend from the outer ring 410 toward a center of the contact structure 206. Each contact 416 comprises a portion that extends downwardly and inwardly from the outer ring 410, which generally follows the contour of the fluid shedding structure 400 of the seal 204. This allows the contacts to shed fluids toward the bus bar 208 during a spin-rinse process.

Further, the downwardly and inwardly extending portion of each contact 206 is spaced from the seal 204. Each contact 206 also comprises an upwardly turned end portion configured to contact a wafer positioned in the cup assembly 102. In this manner, each contact 416 acts as a leaf spring that is pushed against the surface of a wafer in the cup with some spring force to ensure good contact between the contact 416 and the wafer. The contacts may extend at any angle from the outer ring 410. Suitable angles may depend, for example, on the angle of the underlying fluid shedding structure 400 of the seal 204, the desired separation between the contacts 416 and the seal 204, etc. Examples of suitable angles include, but are not limited to, angles in the range of 48 to 54 degrees with respect to a plane of the outer ring 410.

Figure 6:
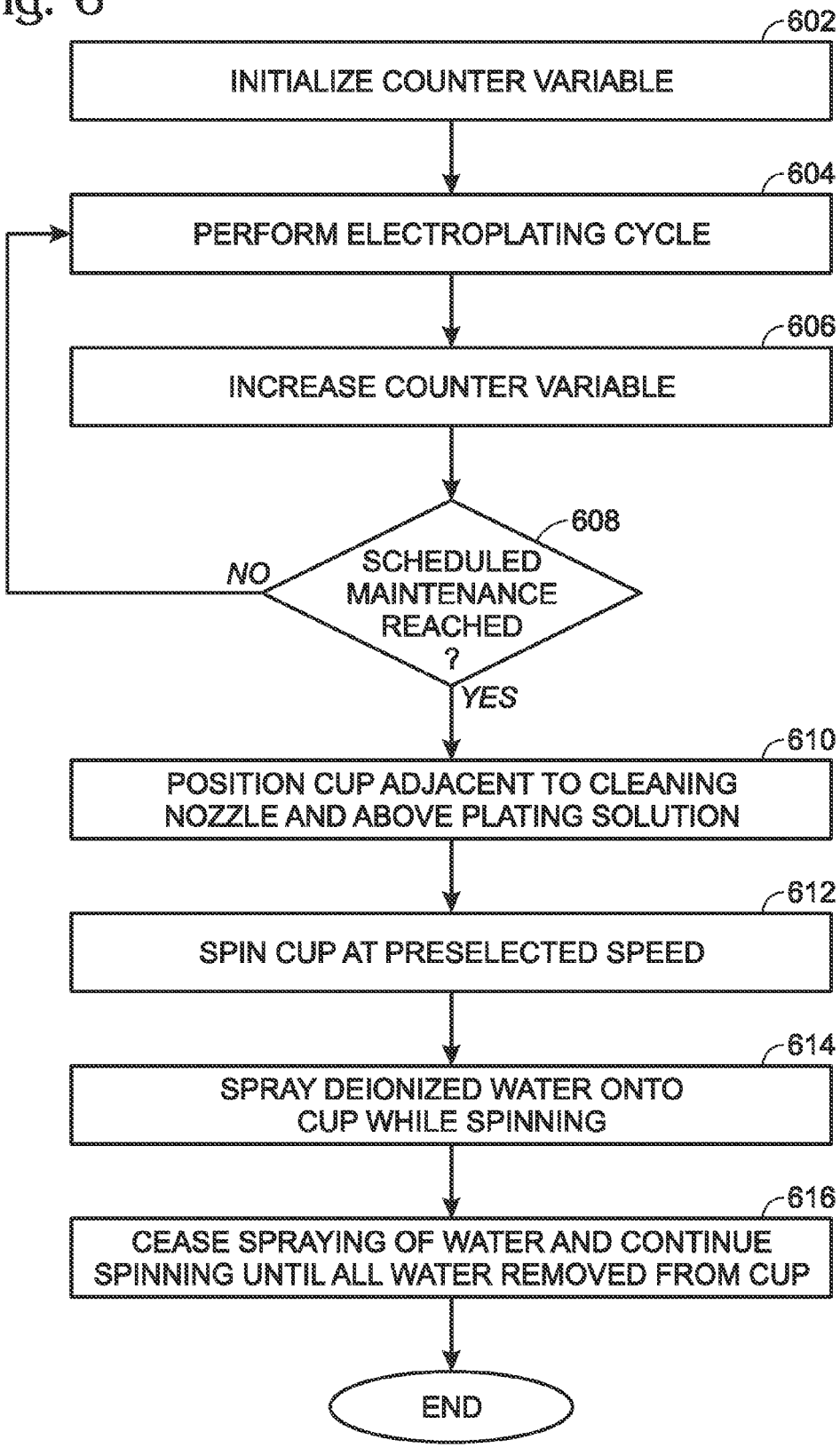
FIG. 6 shows a flow diagram of an embodiment of a method of cleaning an electroplating cup.

Any suitable spin-rinse process may be used to periodically clean the cup assembly 102. One embodiment of a method for cleaning the cup is shown generally at 600 in FIG. 6. First, method 600 comprises, at 602, initializing or resetting a counting variable to allow the tracking of a number of wafer processing cycles that are performed before performing a cleaning process. Next, method 600 comprises, at 604, performing a wafer plating processing cycle, and then, at 606, increasing the counter variable by one.

After each wafer plating processing cycle and counter variable increment, it is determined whether a scheduled cleaning has been reached based upon the value of the counter variable. Any suitable number of processing cycles may be performed before performing a scheduled cleaning. Because the spin-rinse cleaning may be performed quickly while the plating system is on-line, the cleaning may be performed at a greater frequency than a similar manual cleaning process for which a plating system is brought off-line with less effect on system throughput. Examples of suitable numbers of cycles between cleaning include, but are not limited to, 20-40 cycles.

Once it is determined that a scheduled cleaning has been reached, method 600 next comprises, at 610, positioning the cup assembly adjacent to the cleaning fluid nozzle and above (or otherwise out of) the plating solution. Next, at 612, method 600 comprises spinning the cup assembly at a preselected speed that is sufficient to shed water from the interior of the cup assembly, and then, at 614, spraying a cleaning fluid such as deionized water onto the interior surfaces of the cup assembly while spinning the cup assembly. The deionized water is generally of a sufficiently high purity not to introduce contaminants onto the surfaces of the cup assembly.

The cup assembly may be spun at any suitable rate of speed sufficient to cause the removal of water from the interior cup assembly surfaces. Suitable rates of speed include, but are not limited to, rates of approximately 400 rpm or higher. Higher rates of speed may ensure the removal of greater amounts of water, and also may remove the water more quickly, thereby providing for a faster cleaning process. Further, higher rates of speed may also ensure that the rinsate (i.e. rinse solution) from the process does not fall into the plating solution. In one specific embodiment, the cup assembly is spun at a rate of approximately 600 rpm. In other embodiments, rates less than 400 rpm may be used with suitable cup geometries and materials that allow efficient removal of water at such rates.

After the cup assembly has been rinsed sufficiently, the spraying of water is ceased and the cup assembly is spun for a sufficient amount of time to remove substantially all water from the cup assembly, as indicated at 616. Once this process has been completed, method 600 ends. Generally, method 600 will immediately be performed again once it concludes for one scheduled maintenance cycle so that the next preventative maintenance process will occur after the desired number of wafer processing cycles.

Figure 7:
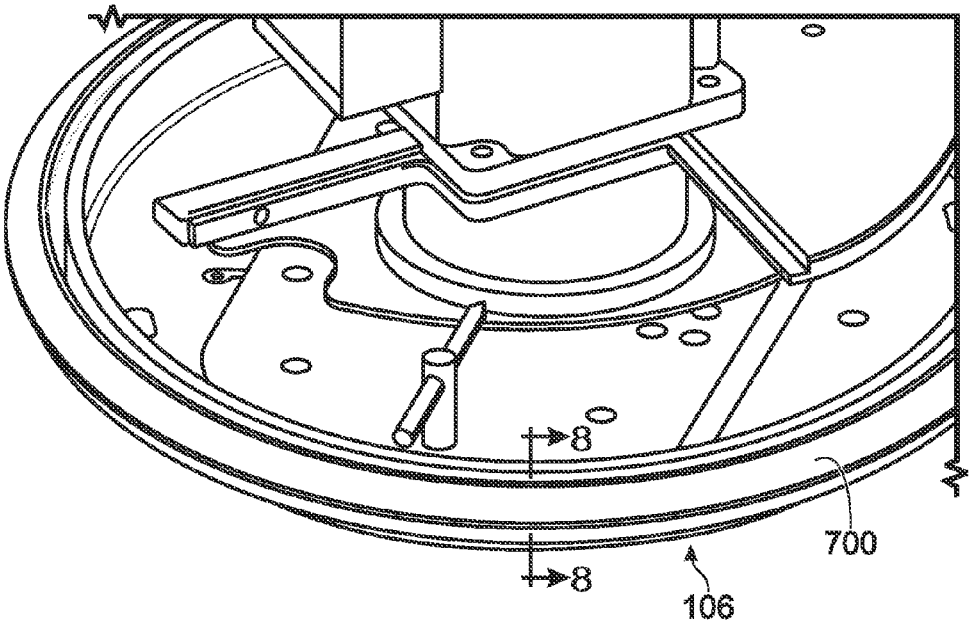
FIG. 7 shows a view of an embodiment of an electroplating cone assembly.
Figure 8:
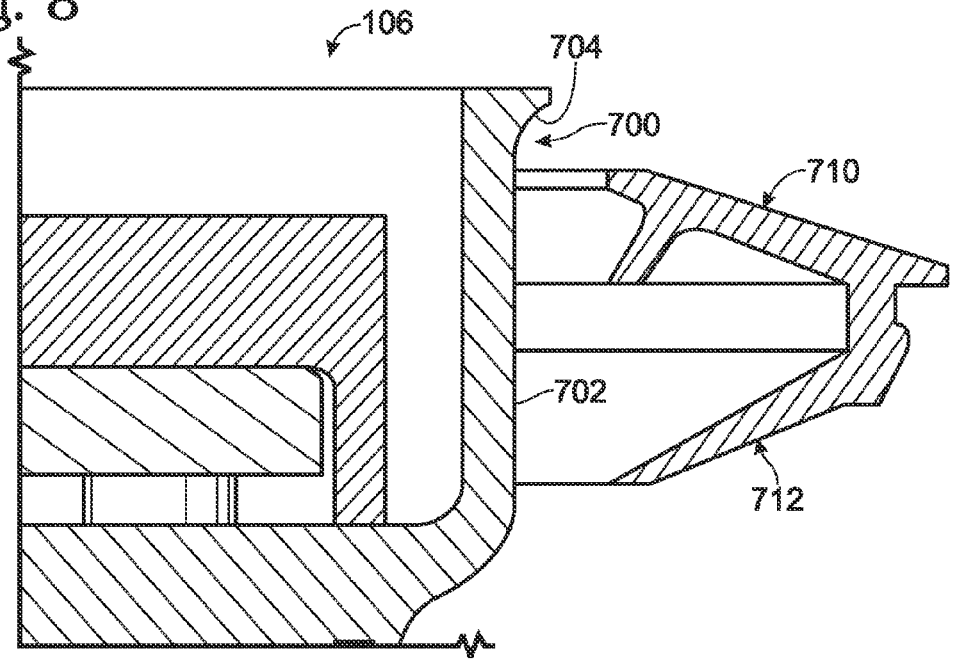
FIG. 8 shows a magnified view of a splash shield of the embodiment of FIG. 7

Continuing with the Figures, FIGS. 7 and 8 show a perspective view of an embodiment of plating cone assembly 106 comprising an integrated splash shield 700, and also shows a rinse ring of a plating cell 710. The combination of the splash shield 700 and rinse ring 710 helps to enable high speed axial entry of the clamshell 100, on the order of 200 mm/s, into a plating cell. At such entry speeds, without a splash shield, the splash from the entry may splash over the cone and gravitate down the struts 212 into the cup assembly 102. The rinse ring 710 is configured to deflect such splash away from the cone assembly 106, and the splash shield 700 helps to ensure that no splashed plating solution reaches the upper portion of the cup, therefore helping to avoid this mode of contamination.

As shown in FIG. 8, the splash shield 700 comprises a vertically oriented wall 702 and an outwardly flared lip 704 that cooperate to deflect splashed plating solution away from the cone assembly 106. The rinse ring 710 likewise comprises a lower surface configured 712 to deflect splash outwardly and downwardly away from the cone assembly 106. Further, the splash shield comprises an outer diameter configured to match the inner diameter of the rinse ring, thereby offering further protection against plating solution splashing outside of the cell.

Use of the disclosed cup assembly 102 in combination with sufficiently frequent spin-rinsing cleaning processes may allow other more disruptive cleaning processes to be performed on a less frequent basis. For example, the contacts of an electroplating cup assembly may be periodically etched by dipping the cup assembly into the plating solution to expose the contacts to the acidic solution, and then rinsing the contacts with deionized water. By employing a periodic automatic spin-rinse process as disclosed above, the contacts may be degraded less by exposure to plating solution residues during a plating process due to ability to perform more frequent cleanings. Therefore, this may enable the more disruptive etching cleaning process to be performed on a less frequent basis, or even scheduled for idle times (rather than after a specific time or number of process cycles), thus reducing system downtime.

It will be understood that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various processes, systems and configurations, and other features, functions, acts, and/or properties disclosed herein, as well as any and all equivalents thereof.

What is claimed is:

1. A seal configured to seal an opening in a closed-contact electroplating cup when a wafer is positioned over the opening and in contact with the seal, the seal comprising:

a sealing structure extending upwardly from an inner edge of the seal;

a fluid shedding surface extending diagonally upwardly and outwardly relative to the sealing structure, wherein the fluid shedding structure is configured to have an angle in the range of 45±10 degrees with respect to a surface of a wafer positioned against the seal; and a hydrophobic coating.

2. The seal of claim 1, wherein the hydrophobic coating at least covers the sealing structure.

3. The seal of claim 1, further comprising a bottom surface contoured to fit a tapered upper side of an electroplating cup assembly.

4. The seal of claim 1, further comprising a keying feature configured to fit a complementary feature in an electroplating cup assembly.

5. The seal of claim 1, further comprising:

a groove configured to accommodate a stiffening ring; and a stiffening ring seated within and bonded to the groove.

6. A seal configured to seal an opening in a closed-contact electroplating cup when a wafer is positioned over the opening and in contact with the seal, the seal comprising:

a sealing structure extending upwardly from an inner edge of the seal;

a fluid shedding surface extending diagonally upwardly and outwardly relative to the sealing structure, wherein the fluid shedding structure is configured to have an angle in the range of 45±10 degrees with respect to a surface of a wafer positioned against the seal; and a keying feature configured to fit a complementary feature in an electroplating cup assembly.

7. The seal of claim 6, wherein the keying feature comprises a protrusion configured to nest within a groove in an electroplating cup assembly.

8. The seal of claim 6, further comprising a hydrophobic coating covering at least the sealing structure.

9. The seal of claim 6, further comprising a bottom surface contoured to fit a tapered upper side of an electroplating cup assembly.

10. The seal of claim 7, further comprising:

a groove configured to accommodate a stiffening ring; and a stiffening ring seated within and bonded to the groove.

11. A seal configured to seal an opening in a closed-contact electroplating cup when a wafer is positioned over the opening and in contact with the seal, the seal comprising:

a sealing structure extending upwardly from an inner edge of the seal;

a fluid shedding surface extending diagonally upwardly and outwardly relative to the sealing structure, wherein the fluid shedding structure is configured to have an angle in the range of 45±10 degrees with respect to a surface of a wafer positioned against the seal; and a bottom surface contoured to fit a tapered upper side of an electroplating cup assembly.

12. The seal of claim 11, further comprising a hydrophobic coating covering at least the sealing structure.

13. The seal of claim 11, further comprising:

a groove configured to accommodate a stiffening ring; and a stiffening ring seated within and bonded to the groove.

14. An annular seal for use in a closed-contact electroplating system, the seal comprising:

an inner edge at least partially defining a sealing structure; and a fluid shedding surface extending radially outwardly from the inner edge at an upward angle, wherein the upward angle is 45±10 degrees.

15. The seal of claim 14, further comprising a hydrophobic coating at least covering the sealing structure.

16. The seal of claim 14, further comprising a bottom surface contoured to fit a tapered upper side of an electroplating cup assembly.

17. The seal of claim 14, further comprising a keying feature configured to fit a complementary feature in an electroplating cup assembly.

18. The seal of claim 14, further comprising a groove configured to accommodate a stiffening ring.

19. A seal configured to seal an opening in a closed-contact electroplating cup when a wafer is positioned over the opening and in contact with the seal, the seal comprising:

a sealing structure extending upwardly from an inner edge of the seal;

a fluid shedding surface extending diagonally upwardly and outwardly relative to the sealing structure;

a hydrophobic coating;

a groove configured to accommodate a stiffening ring; and a stiffening ring seated within and bonded to the groove.

20. The seal of claim 19, wherein the hydrophobic coating at least covers the sealing structure.

21. The seal of claim 19, further comprising a bottom surface contoured to fit a tapered upper side of an electroplating cup assembly.

22. The seal of claim 19, further comprising a keying feature configured to fit a complementary feature in an electroplating cup assembly.

23. A seal configured to seal an opening in a closed-contact electroplating cup when a wafer is positioned over the opening and in contact with the seal, the seal comprising:

a sealing structure extending upwardly from an inner edge of the seal;

a fluid shedding surface extending diagonally upwardly and outwardly relative to the sealing structure;

a keying feature configured to fit a complementary feature in an electroplating cup assembly;

a groove configured to accommodate a stiffening ring; and a stiffening ring seated within and bonded to the groove.

24. The seal of claim 23, wherein the keying feature comprises a protrusion configured to nest within a groove in an electroplating cup assembly.

25. The seal of claim 23, further comprising a bottom surface contoured to fit a tapered upper side of an electroplating cup assembly.

26. A seal configured to seal an opening in a closed-contact electroplating cup when a wafer is positioned over the opening and in contact with the seal, the seal comprising:

a sealing structure extending upwardly from an inner edge of the seal;

a fluid shedding surface extending diagonally upwardly and outwardly relative to the sealing structure;

a bottom surface contoured to fit a tapered upper side of an electroplating cup assembly;

a groove configured to accommodate a stiffening ring; and a stiffening ring seated within and bonded to the groove.

27. The seal of claim 26, further comprising a hydrophobic coating covering at least the sealing structure.

* * * * *

UNITED STATES PATENT AND TRADEMARK OFFICE

CERTIFICATE OF CORRECTION

PATENT NO. : 8,398,831 B2
APPLICATION NO. : 13/079745
DATED : March 19, 2013
INVENTOR(S) : Shantinath Ghongadi et al.

It is certified that error appears in the above-identified patent and that said Letters Patent is hereby corrected as shown below:

Title Page, Item 75 (Inventors), Line 4, change "Lake Owsego," for Seshasayee Varadarajan to --Lake Oswego,--.

Title Page, Item 74 (Attorney), Line 1, change "Martins" to --Martens--.

In the Claims:

At Column 8, Line 28, in Claim 10, change "claim 7," to --claim 6,--.

Signed and Sealed this
First Day of October, 2013

Teresa Stanek Rea

Teresa Stanek Rea
*Deputy Director of the United States Patent and Trademark Office*